US006146245A

United States Patent [19]

Kremen et al.

[11] Patent Number: 6,146,245

[45] Date of Patent: Nov. 14, 2000

[54] METHOD OF AND DEVICE FOR MACHINING FLAT PARTS

[75] Inventors: Gennady Kremen, Brooklyn, N.Y.; Leonid Igelshteyn, Manalapan; Savva Feygin, Manalpan, both of N.J.

[73] Assignee: Scientific Manufacturing Technologies, Inc.

[21] Appl. No.: 09/305,444

[22] Filed: May 6, 1999

[51] Int. Cl.[7] ..... B24B 31/112

[52] U.S. Cl. ..... 451/36; 451/262; 451/165; 451/288; 451/57; 451/291; 451/41

[58] Field of Search ..... 451/28, 41, 35, 451/65, 910, 36, 59, 61, 60, 288, 262, 57, 291

[56] References Cited

U.S. PATENT DOCUMENTS

| | | | |
|---|---|---|---|
| 3,813,828 | 6/1974 | Bennett | 451/291 |
| 4,211,041 | 7/1980 | Sakulevich et al. | 451/191 |
| 4,821,466 | 4/1989 | Kato et al. | 451/36 |
| 5,449,313 | 9/1995 | Kordonsky et al. | 451/36 |
| 5,575,706 | 11/1996 | Tsai et al. | 451/41 |
| 5,676,587 | 10/1997 | Landers et al. | 451/57 |
| 5,775,976 | 7/1998 | Kremen et al. | 451/36 |
| 5,813,901 | 9/1998 | Kremen | 451/28 |
| 5,913,712 | 6/1999 | Molinar | 451/57 |
| 5,931,718 | 8/1999 | Komanduri et al. | 451/36 |

*Primary Examiner*—David A. Scherbel
*Assistant Examiner*—G Nguyen
*Attorney, Agent, or Firm*—I. Zborovsky

[57] ABSTRACT

A method of machining flat parts, includes the use of two permanent magnets which are located opposite to and spaced from one another so as to form a magnetic field with a magnetic flux extending perpendicular to the magnets, placing a flat part in the magnetic field between the magnets so that the magnetic flux extends through the flat part, supplying a magnetic-abrasive powder to the flat part in the magnetic field, and performing a relative movement between at least one of the magnets and the flat part so as to remove a material from a surface of the flat part.

15 Claims, 3 Drawing Sheets

METHOD OF AND DEVICE FOR MACHINING FLAT PARTS

BACKGROUND OF THE INVENTION

The present invention relates to a method of machining of flat parts, such as for example silicon wafers.

Machining of silicon wafers are known in the art. For producing silicon wafers, silicon ingots with a cylindrical shape are sliced into the thin wafers by cut-off grinding. The wafer circumference is ground with a profiled diamond wheel, so-called edge rounding. Then the wafers have to be lapped to ensure precise thickness, flatness, and parallelism. After this process, a chemical etch treatment is used. The wafer is then polished by chemical-mechanical polishing on one side, with surface roughness in the vicinity of 5 nm.

During edge rounding of silicon wafer distinct scratches are produced occasionally by silicon particles which break away from the wafer periphery. In order to avoid this edge-chipping, the wafer circumference is ground with a profiled diamond wheel in accordance with a traditional approach. During the cut-off grinding, edge-chipping of the wafer circumference takes place. This is precisely the etch chipping which is a source of breakage of wafers during the subsequent lapping. There is no other reason why the edge-rounding is used, in particular to avoid the edge chipping of the wafer circumference and to prevent breakages of wafers during lapping.

Double-side lapping process has several disadvantages. First of all, in order to perform the processing of cutting, rigid kinematic connection is used between a workpiece, abrasive grains and lapping plates. This rigid kinematic connection leads to necessity of utilization of rigid, massive, precise power tools with a rigid frame essential for vibration-free operation, and the lapping plates are machined together with the part to be machined, so that they change their shape and as a result, accuracy of machining is lost. In particular, it results in a spherical flatness of the upper and lower plate surfaces which affects thickness variations, parallelism and flatness of the workpiece. As a result, the lapping plates are continuously machined to obtain required shape. Also, brittle and hard workpieces (for example silicon wafers) are broken since they are integrated in the rigid kinematic system of the power tool.

For cutting a slurry is utilized. The slurry contains abrasive grains of various sizes in water or oil base. The presence of slurry leads to the fact that it is no longer possible to use liquid for removal of cutting products from a machining zone, since liquid washes off oil or water utilized for retention of grains in the machining zone. Swarf remains in the machining zone and is not removed, while abrasive grains engage into it. It is not possible to increase the speed of cutting, and the number of revolutions does not exceed 120 per minute, since oil and water can not retain abrasive grains in the machining zone in condition of high rotary speeds.

Provision of the rigid kinematic connection and the slurry leads to the use during machining of abrasive grains having different sizes, in particular large sizes in order to increase a material removal rate and small sizes in order to obtain a high quality surface of workpiece. The use of the large grains increases a depth of damage which results to unavoidable warping of workpieces and difficulties in obtaining parallelism and flatness. The use of small grains leads to a loss of efficiency of machining. Also, with the rigid kinematic connection and the slurry the requirements for a precise grading of abrasive gains are necessary. A tolerance of the grain size does not exceed several $\mu$m. Such particles can scratch or fracture the workpiece and do not contribute to improvement of surface finish. Finally, it is necessary to provide several types of lapping plates in order to obtain the desired quality of surfaces to be machined.

It is known to provide machining of wafers with the use of magnetic-abrasive process, as disclosed for example in U.S. Pat. No. 5,239,172. The disadvantage of this method is that an electromagnet with a yoke, coil and poles is utilized in this process. It is well known that in electromagnets with the increase of surface of pole faces, the field diminishes directly proportionally. For example,

| $S_1MM^2$ | ϕ, MM | Field, T |
|---|---|---|
| 314 | ϕ20 | 1.756 |
| 1'256 | ϕ40 | 1.333 |
| 2'025 | Square 45 | 0.916 |
| 3'300 | ϕ65 | 0.202 |

whereas an 5 is an area and 6 a diameter of pole faces. These values of the magnetic field are obtained with the pole gaps 5 mm, magnet current maximum 5.0 amps with water cooling (Operation Manual, Laboratory Electromagnet, Model 347 GMW).

Thus, for this invention, with the pole face formed as rings 25*a* and 25*b*, a field gradient will be insufficient for the magnetic abrasive machining with S pole equal to or more than 2000 $mm^2$, since the powder will not be retained in a gap during machining. Moreover, the presence of yoke increases the size of the power tool, and the connection of the disks by a rotary shaft extending through the center of the disks makes impossible machining of a workpiece with a whole surface of the pole face. Therefore, the center of the workpiece can not be machined with this device if its diameter is greater than the diameter of disks. All above mentioned disadvantages result in a limitation to the diameters of the workpieces to be machined. On the other hand, currently the diameters of silicon wafers reach 400 mm, and the diameter of machining with setting of 10 wafers reaches 2000 mm.

Magnetic abrasive machining disclosed in U.S. Pat. No. 4,211,041 has the disadvantages of a weak magnetic field and gradient between poles, due to the fact that poles of two electromagnet systems are not connected by yoke, but instead are connected by direct and feedback electrical connection. Also, when the pole of the rotor is located in a gap between the poles of the conductor. The machining is not performed at all. Between this extreme conditions, the workpieces are machined only partially. Finally, the electric circuitry is connected with changing of polarity of the rotor electromagnetic poles so that each counter opposed pair of inductors and rotor poles will have a different polarity which is very complicated.

The existing chemical-mechanical polishing has its own disadvantages. In particular, the wafer is hard to clean, it has a relatively high cost, it is of limited productivity, and single-pass system and end-point detection are unavailable. In this process, a polishing pad, slurry and special wafer clamping technique are utilized. Silicon wafer requires polishing in several stages, in particular initially the wafer surface has to be polished for removing surface defects, then oxide surface after each lithography step has to be removed and than action process must be formed to achieve planarization. The polishing fluid is an alkaline solution which contains chemical reactive particles with a size of approximately 100 nm. The material removal rate in this process involves chemical and mechanical process. A rise of temperature significantly increases the material removal rate. A significant part of the relatively high cost of this treatment is the cost of reactive particles with the size of 100 nm.

SUMMARY OF THE INVENTION

Accordingly, it is an object of the present invention to provide a machining of flat parts, which avoids the disadvantages of the prior art.

In keeping with these objects and with others which will become apparent hereinafter, one feature of present invention resides, briefly stated, in a method of flat parts, such as for example of machining silicon wafers which comprises providing two permanent magnets which are located opposite to and spaced form one another so as to form a magnetic field with a magnetic flux extending perpendicular to the magnets, placing a wafer in the magnetic field between the magnets so that the magnetic flux extends through the wafer, supplying a magnetic-abrasive powder to the wafer in the magnetic field, and performing a relative movement between at least one of the magnets and the wafer so as to remove a material from a surface of the wafer.

It is also another feature of present invention to provide a device for machining of flat parts, such as for example of silicon wafers which includes two permanent magnets which are located opposite to and spaced from one another so as to form a magnetic field with a magnetic flux extending perpendicular to the magnets, means for placing a wafer in the magnetic field between the magnets so that the magnetic flux extends through the wafer, means for supplying a magnetic-abrasive powder to the wafer in the magnetic field, means for performing a relative movement between at least one of the magnets and the wafer so as to remove a material from a surface of the wafer.

When the method is performed and the device is designed in accordance with the present invention and utilize permanent magnets for forming a magnetic field in which a flat part is subjected to magnetic-abrasive machining, it avoids the disadvantages of the prior art and provides for the highly advantageous results.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
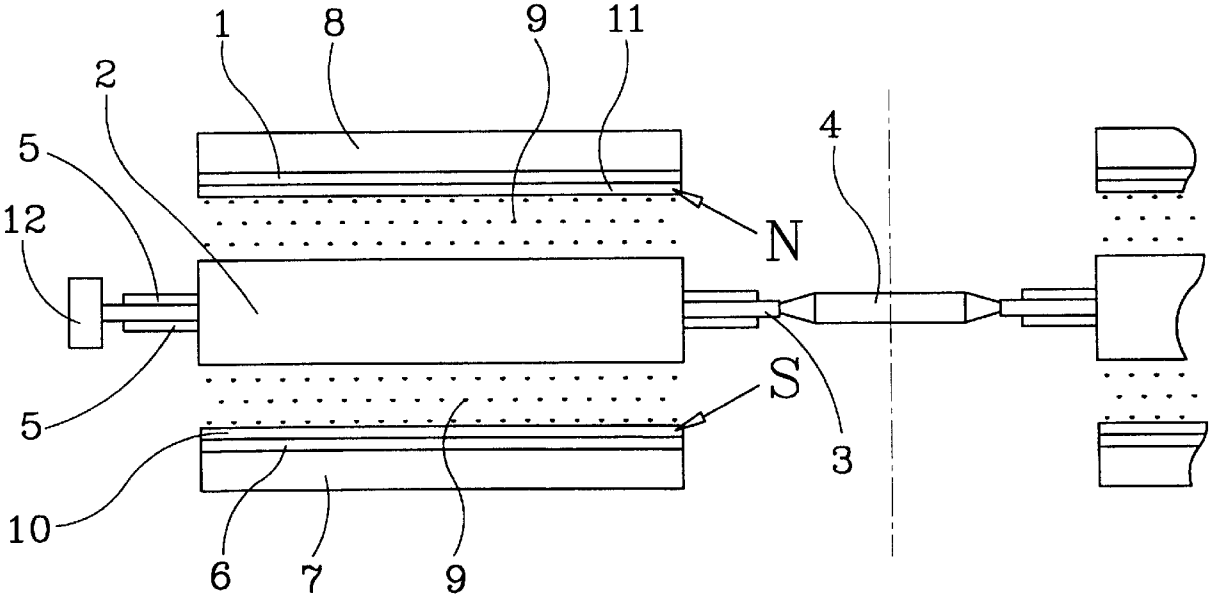
FIG. 1 is a view schematically showing the device for double-side magnetic-abrasive machining of flat parts, such as for example silicon wafers in accordance with the present invention.

A method of and a device for machining of flat parts, such as for example silicon wafers in accordance with the present invention is shown in FIG. 1. The method is performed and the device is based on a double-side machine which has a lower rotating plate 7 and an upper rotating plate 8. Workpieces are placed on workpiece 2 carriers 3 between the lower and upper plates which rotate in opposite directions around an axis A. Positioned between the plates, the workpieces carriers are driven by an inner pin ring 4 which rotates around an outer pin ring 12. Essentially, a sun-and-planet epicyclic system with a planetary motion is produced.

The lower and upper plates are made of a non-magnetic material. A not shown ring-shaped boxes are placed on the plates and composed also of a non-magnetic material. The sides of the boxes which face toward one another are made of a non-magnetic material or soft steel and form pole faces 10 and 11. The ring-shaped permanent magnets 1 and 6, each forming a single pole of a corresponding sign composed for example of neodymium are arranged in the boxes. As always, they are assembled of several individual magnets and magnetized so that the pole faces of each ring-shaped box has opposite poles facing one another.

Before machining of the wafers, a powder 9 is supplied to south (S) and north (N) poles when they do not interact with one another. The abrasive grains are as a rule large of the order of 100 $\mu$m, since during the process of machining they have to achieve a minimal roughness and a maximal material removal rate.

In the inventive method the irregularly sized particles can not scratch or fracture the workpiece during the magnetic-abrasive process. In the conventional abrasive processes, the use of larger abrasive grain sizes lead to a higher material removal rate but at the same time to an increased roughness while sizes result in a smaller material removal rate and reduced roughness. It is therefore necessary in all abrasive processes to use same different sizes of grains in multiple steps in order to attain the desired surface finish. However, in an event method it has been found that the surface roughness of the machine workpiece suing magnetic-abrasive processes and does not depend on grain size of magnetic-abrasive powder. On the other hand the material removal rated depends on the size of the grain of the powder and indeed there is an optimal material removal rate for a given size of the abrasive grains. As a result, for the process in accordance with the present invention, grains from 0.5 to 120 $\mu$m can be utilized. The wafers are arranged in the workpiece carriers so that each carrier carries only one wafer. The carriers with the wafers are moved in templates 5 formed as rings with openings having the shape of the wafers, or in other words with the openings which are open for machining of only wafers. Templates are necessary for closing the teeth of carriers from magnetic-abrasive powder. The powder is not supplied to the non-magnetic carriers. A liquid is supplied into a machining zone between the N and S poles for washing out of products of cutting with abrasive is separated from powder grains.

When the poles are moved toward one another, the powder is attracted to an opposite pole of a magnet. In other words, a cutting force is provided. For cutting a corresponding movement is performed, which can be executed as:

rotation of a wafer together with the carrier, rotation of wafers around the axis of rotation of the upper and lower plates, rotation of each of the plates in opposite directions.

During the cutting movement the powder is moved together with the poles of the magnets. Each pole rotates its powder which is closer to the pole. During rotation of the upper plate, only upper layer of the powder is rotated. During rotation of the lower plate, only a lower layer of the powder is rotated. There is no rigid kinematic connection between the wafer and the powder. The powder is pressed toward the wafer exclusively by forces of the magnetic field. There is also no rigid connection with the machine tool and therefore the inaccuracies of the machine tool do not affect the wafer.

Figure 2:
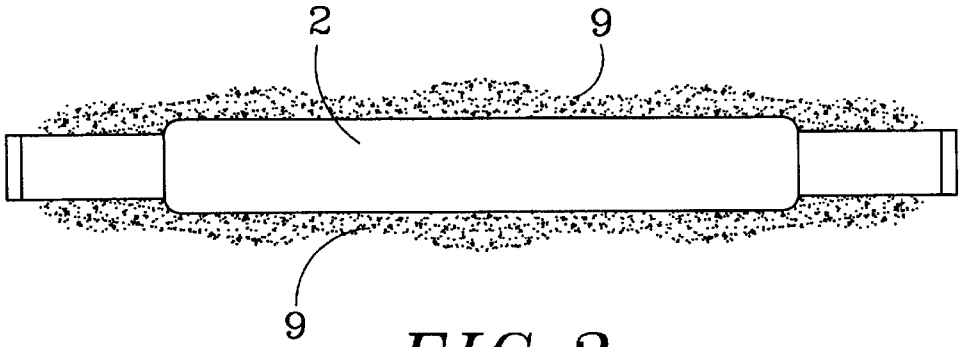
FIG. 2 is a view schematically showing an edge magnetic-abrasive machining of flat parts, such as for example a silicon wafer in accordance with the inventive method.

Here, simultaneously with machining of the wafer surface, edge round up is performed as shown in FIG. 2, and also machining of the templates is performed as well.

In order to move apart the upper and lower plates it suffices to reduce the attraction force of the magnets to one another. Traditional devices which reduce the magnetic field in equipment with permanent magnets can be utilized for this purpose.

The magnetic abrasive. The magnetic polishing powder is made in correspondence with the same patent powder which is used in the inventive process is a powder which can be made in accordance with our U.S. Pat. No. 5,846,270. It has a magnetic component including powder particles of a magnetic material, a polishing component including powder particles of a polishing material, and an adhesive which adhesively connects the particles of the magnetic material and the particles of the polishing material. As a polishing material, chemical reactive particles with a size of approximately 100 $\mu$m are utilized. The utilization of particles which is 1000 times larger than the particles of the chemical-mechanical polishing makes the method in accordance with the present invention substantially less expensive.

Figure 3:
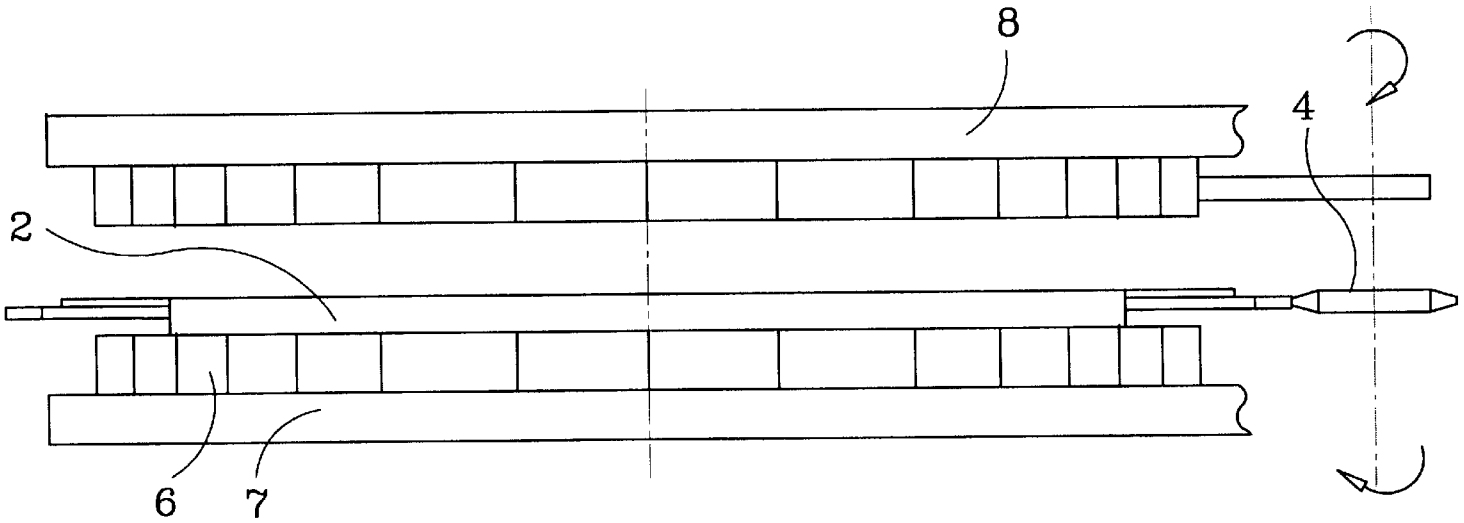
FIG. 3 is a view schematically showing the inventive device which performs one-side magnetic-abrasive polishing of a silicon wafer on a double magnetic-abrasive machine.

The device for magnetic abrasive polishing of silicon wafers in accordance with the present invention is shown in FIG. 3. It utilizes a double-sided lapping machine. At this stage of machining of wafers it is necessary to machine its one side. In this step, it is no longer necessary to use the wafer clamping technique with pressing of the wafer onto a flexible disk so that it adheres to the polishing head, a polishing pad and a slurry.

Figure 4:
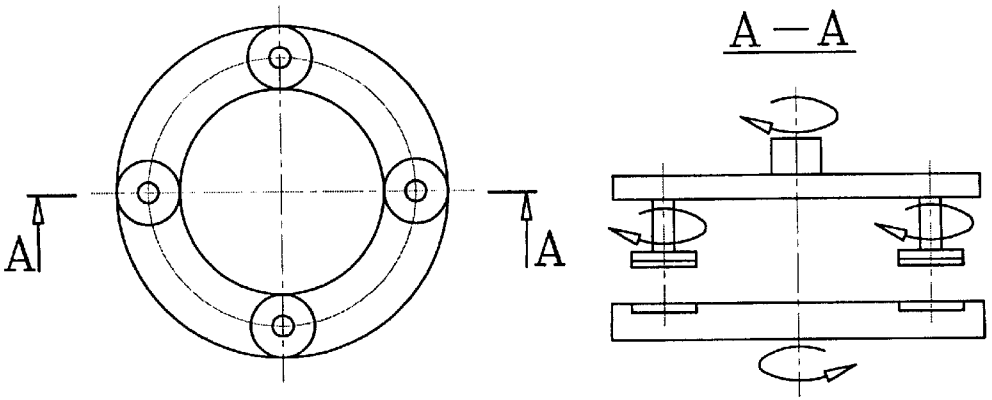
FIG. 4 is a view showing the inventive device for a one-side magnetic-abrasive polishing of the silicon wafer after lithography and etching.

In order to remove the oxidized surface layer after each a lithography step and an etching step, a device shown in FIG. 4 is utilized. For polishing and removing of oxide layer a soft magnetic polishing powder is used with soft grains up to 120 $\mu$m.

Figure 5:
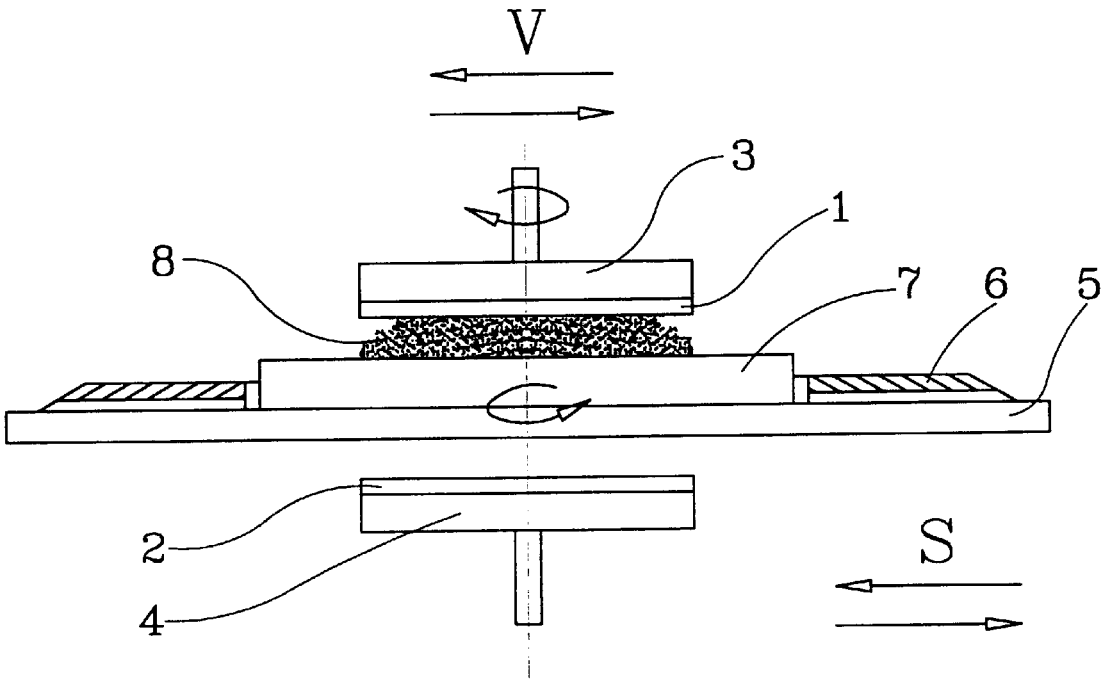
FIG. 5 is a view showing a kinematic diagram of a one side magnetic-abrasive machining or magnetic-polishing with the inventive method.

A shown in FIG. 5, a magnetic field is generated between pole faces of the magnets with N pole 1 and S pole 2. The poles can be composed of magnetic or non magnetic material, or at all they can be not present.

The magnets (rear magnets) 13 and 14 have a round shape or a square shape. In the even of the round shape, the magnet operates with its inscribed circumference. The magnets are located at a distance of 10–15 mm. A table 15 is located between them with a workpiece 16 fixed on the table by a template 17. The axes of the magnets as a rule coincide with one another. The diameter of the upper magnet as a rule is less than the diameter of the lower magnet by 5–30 mm. With a diameter increase, it is necessary to increase a diameter difference between the magnets. This is done to reduce a dead zone in a center of the workpiece to be machined.

The machining is performed in the following manner. The workpiece 16 is placed in the template 17 fixed on the table. A workpiece of a larger diameter is placed in a center of the table, while for a workpiece of a smaller diameter, the whole area of the table is utilized. The powder 18 covers the surface of the upper magnet facing toward the workpiece, when the magnet is spaced from the workpiece by distance such that the powder is attracted only to it. Then the upper magnet is lowered. At the beginning the powder located in the center of the upper magnet is attracted to the center of the workpiece, and then the remaining part of the powder fills a gap between the workpiece and the upper magnet. In this position, the powder is attracted by both the lower magnet and the upper magnet. For a cutting process, it is necessary to press the powder to the workpiece by the lower magnet, while the upper magnet is rotated. Therefore, the distance X is always greater than or equal to the distance Y. Then, rotation of the upper magnet and rotation of the table together with the workpiece are switched on. The rotation of the workpiece is a circular feed, while the rotation of the upper magnet with the powder is a cutting movement. Correspondingly, a cutting speed must be tens times greater than the speed of feeding (V=1.5 m/s and $V_{ocs}$=0.1 m/s).

The longitudinal feed of the table with the workpiece is turned on. Both feeding movements are necessary in order to provide a uniform machining of the workpiece surface. In other words, the surface of the workpiece must be machined at the same time with the same speed. These values: rotation speed of workpiece, rotation speed of upper magnetic, longitudinal feed of the table, diameter of the surface to be machined, and diameter of the upper magnet, must be coordinated for performing a uniform machining of the whole surface of the workpiece.

Then the oscillation of the upper magnet is turned on, which is necessary for reducing of roughness of the surface to be machined, increase of material removal rate, and reduction of deviation from flatness or form. A liquid is supplied into a machining zone. The edge of the workpiece of workpieces must also reach the center of magnets.

When it is necessary to provide great material removal from a hard part to be machined, in all above explained methods and devices it is necessary to use a force of attraction of the upper and lower magnets. In other words, during machining of for example wafers composed of ceramics, one of the magnets is not fixed in direction of the flux lines. Thereby, due to the increase of the attractive force of the magnets which corresponds to the force of cutting, the material removal weight is increased.

It will be understood that each of the elements described above, or two or more together, may also find a useful application in other types of methods and constructions differing from the types described above.

While the invention has been illustrated and described as embodied in method of and device for machining silicon wafers, if is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the genetic or specific aspects of this invention.

What is claimed as new and desired to be protected by Letters Patent is set forth in the appended claims.

What is claimed is:

1. A method of machining a flat part, comprising arranging two plates having faces which face one another and are provided with permanent magnets which are located opposite to and spaced from one another so as to form a magnetic field with a magnetic flux extending perpendicular to said permanent magnets with one of said permanent magnets forming as a whole a single pole of one sign and the other of said permanent magnets forming as a whole a single pole of an opposite sign; placing a flat part in said magnetic field between said permanent magnets so that said magnetic flux extends through said flat part; supplying a magnet-abrasive powder to said flat part in said magnetic field; and performing a relative movement between at least one of said permanent magnets and said flat part.

2. A method as defined in claim 1, wherein said relative movement includes rotating the flat part relative to at least one of said magnets.

3. A method as defined in claim 1, wherein said relative movement includes rotating at least one of said magnets relative to the flat part.

4. A method as defined in claim 1, wherein said relative movement includes rotating of both said magnets relative to said flat part.

5. A method as defined in claim 1, wherein said relative movement includes rotating and longitudinally displacing the flat part relative to at least one of said magnets.

6. A method as defined in claim 5, wherein said relative movement also includes rotating of said magnets relative to the flat part.

7. A method as defined in claim 1, wherein said magnets are ring-shaped magnets, said relative movement including rotating the flat part circumferentially around an axis of said ring-shape magnets.

8. A method as defined in claim 1, wherein said supplying and performing includes first supplying a magnetic-abrasive powder and machining fluid with sizes of abrasive grains in the magnetic-abrasive powder up to 120 $\mu$m, and performing a relative movement between at least one of said magnets and the flat part so as to remove a material from a surface of the flat part in a preliminary machining; and second supplying a magnetic-polishing powder and polishing fluid to said flat part in said magnetic field with sizes of polishing grains in the magnetic-polishing powder up to 120 $\mu$m, and performing a relative movement between at least one of said magnets and the flat part so as to provide a polishing of the surface of the flat part.

9. A device for machining a flat part, comprising two plates having faces which face one another and are provided with permanent magnets which are located opposite to and spaced from one another so as to form a magnetic field with a magnetic flux extending perpendicular to said permanent magnets with one of said permanent magnets forming as a whole a single pole of one sign and the other of said permanent magnets forming as a whole a single pole of an opposite sign; means for placing a flat part in said magnetic field between said permanent magnets so that said magnet flux extends through said flat part; means for supplying a magnetic-abrasive powder to said flat part; means for supplying a magnetic-abrasive powder to said flat part in said magnetic field; and means for performing a relative movement between at least one of said permanent magnets and the flat part.

10. A device as defined in claim 9, wherein said means for relative movement performs rotating the flat part relative to at least one of said magnets.

11. A device as defined in claim 9, wherein said means for relative movement performs rotating at least one of said magnets relative to the flat part.

12. A device as defined in claim 9, wherein said means for relative movement performs rotating of both said magnets relative to said flat part.

13. A device as defined in claim 9, wherein said means for relative movement performs rotating and longitudinally displacing the flat part relative to at least one of said magnets.

14. A device as defined in claim 13, wherein said means for relative movement also performs rotating of said magnets relative to the flat part.

15. A device as defined in claim 9, wherein said magnets are ring-shaped magnets, said means for relative movement performing the flat part circumferentially around an axis of said ring-shaped magnets.

* * * * *